US005340414A

United States Patent [19]

Asai et al.

[11] Patent Number: 5,340,414

[45] Date of Patent: Aug. 23, 1994

[54] HEAT-RESISTANT FERRITIC CAST STEEL MEMBER

[75] Inventors: Hiroshi Asai; Nobuhide Takeshige; Yasuo Uosaki; Masahiko Shibahara; Motofumi Omori; Shigenori Morimoto, all of Hiroshima, Japan

[73] Assignee: Mazda Motor Corporation, Hiroshima, Japan

[21] Appl. No.: 973,284

[22] Filed: Nov. 9, 1992

[30] Foreign Application Priority Data

Nov. 15, 1991 [JP] Japan ..... 3-328136

[51] Int. Cl.[5] ..... C22C 38/32

[52] U.S. Cl. ..... 148/325; 148/326; 420/64

[58] Field of Search ..... 148/326, 325; 420/64

[56] References Cited

U.S. PATENT DOCUMENTS 3,798,075 3/1974 Bendel ..... 148/326

FOREIGN PATENT DOCUMENTS 1159354 6/1989 Japan .

*Primary Examiner*—Deborah Yee

*Attorney, Agent, or Firm*—Sixbey, Friedman, Leedom & Ferguson

[57] ABSTRACT

A heat-resistant ferritic cast steel member composed of 0.05 to 0.25 wt % of C, 0.3 to 2.0 wt % of Si, 0.2 to 1.0 wt % of Mn, not more than 0.05 wt % of P, not more than 0.05 wt % of of S, 16 to 20 wt % of Cr, 0.5 to 1.5 wt % of Nb, 0.02 to 0.15 wt % of B and balance to 100 of Fe is cast in a lost model made of foamed polymethyl methacrylate.

3 Claims, 3 Drawing Sheets

HEAT-RESISTANT FERRITIC CAST STEEL MEMBER

BACKGROUND OF THE INVENTION

1. Field of the Invention

This invention relates to a heat-resistant ferritic cast steel member which is excellent in resistance to thermal fatigue and resistance to oxidation and is suitable for parts of the exhaust system of a vehicle such as an exhaust manifold, a flange for an exhaust pipe and the like, and to a method of manufacturing the same.

2. Description of the Prior Art

Conventionally, parts of the exhaust system of a vehicle have been generally made of heat-resistant cast iron such as high-silicon ductile cast iron or Ni-resist cast iron.

Though having excellent casting properties, those heat-resistant cast irons have become insufficient in resistance to heat as the output power of the automotive engines increases and the temperature of exhaust gas increases.

It has been known that ferritic cast stainless steel containing therein 16 to 20 wt % Cr is excellent in resistance to heat. However such ferritic cast stainless steel is poor in resistance to fatigue due to separation of coarse chrome carbide.

For example, in Japanese Unexamined Patent Publication No. 1(1989)-159354, there is disclosed ferritic cast stainless steel having the following composition.

C—0.06 to 0.20 wt %; N—0.01 to 0.10 wt %; Si—0.4 to 2.0 wt %; Mn—0.3 to 1.0 wt %; P—not more than 0.04 wt %; S—not more than 0.04 wt %; Cr—15 to 22 wt %; Nb—0.01 to 2.0 wt %; Ti—0.01 to 0.10 wt %; Mo—0.2 to 1.0 wt %; Ni—0.01 to 1.0 wt %; Y and/or Ce—0.01 to 0.2 wt %; W—0.01 to 1.0 wt %; B—0.001 to 0.01 wt %; V—0.01 to 1.0 wt %; Fe—balance to 100

Though the ferritic cast stainless steel contains boron, the boron content is too small to prevent separation of coarse chrome carbide which adversely affects resistance to thermal fatigue.

When a heat-resistant ferritic cast steel member is cast by conventional sand casting, a core which conforms to the shape of the member is necessary, which results in poor dimensional accuracy and poor yield due to large sinkage, and when burr is generated along the parting line, the burr is hard to chip due to toughness of the material, which greatly deteriorates productivity. If the heat-resistant ferritic cast steel member is cast by use of foamed polystyrene lost model instead of sand casting, carbon enters molten metal when the lost model is substituted by molten metal and sever carburizing phenomenon takes place, whereby carbides separate near the surface of the product and resistance to thermal fatigue and machinability greatly deteriorate.

SUMMARY OF THE INVENTION

In view of the foregoing observations and description, the primary object of the present invention is to provide a heat-resistant ferritic cast steel member which is excellent in fatigue strength and resistance heat.

Another object of the present invention is to provide a method of manufacturing a heat-resistant ferritic cast steel member which is excellent in fatigue strength, resistance to heat and machinability.

The heat-resistant ferritic cast steel member in accordance with the present invention is composed of 0.05 to 0.25 wt % of C, 0.3 to 2.0 wt % of Si, 0.2 to 1.0 wt % of Mn, not more than 0.05 wt % of P, not more than 0.05 wt % of of S, 16 to 20 wt % of Cr, 0.5 to 1.5 wt % of Nb, 0.02 to 0.15 wt % of B and balance to 100 of Fe, fine niobium carbide particles being dispersed.

When the C content is not more than 0.05 wt %, casting properties of the cast steel greatly deteriorate and niobium carbide cannot be formed in a proper amount. When the C content is not less than 0.25 wt %, an excessive amount of coarse carbide particles is formed, which deteriorates toughness and machinability.

Si serves as deoxidant, and the Si content should be not less than 0.3 wt % to suppress gas defect and to improve flowability of molten metal. When the Si content is more than 2.0 wt %, toughness and machinability deteriorate.

Mn is effective as deoxidant, and when the Mn content is not more than 0.2 wt %, casting properties deteriorate. When the Mn content is not less than 1.0 wt %, toughness and machinability deteriorate.

When the P content is not less than 0.05 wt %, machinability and resistance to heat deteriorate due to formation of pearlite and/or steatite.

Though S improves machinability, a S content of not less than 0.05 wt % deteriorates resistance to heat.

Cr is important to form a single phase of ferrite, thereby ensuring stable material characteristics up to a high temperature and resistance to thermal fatigue, and the Cr content should be not less than 16 wt % for the purpose. When the Cr content exceeds 20 wt %, coarse Cr carbide particles are formed and resistance to thermal fatigue greatly deteriorates in the case where a large product is cast or cooling speed is lowered.

Nb is an important element which combines with C to form Nb carbide and suppresses formation of coarse Cr carbide particles, thereby greatly improve resistance to heat. For this purpose, the Nb content should be not less that 0.5 wt %. When the Nb content is not less than 1.5 wt %, toughness deteriorates.

B serves to micronize crystal size and suppresses formation of coarse Cr carbide particles which adversely affect resistance to thermal fatigue. The B content should be not less than 0.02 wt % for this purpose. When the B content is not less than 0.15 wt %, toughness deteriorates.

The method of the present invention is for casting a heat-resistant ferritic cast steel member composed of 0.05 to 0.25 wt % of C, 0.3 to 2.0 wt % of Si, 0.2 to 1.0 wt % of Mn, not more than 0.05 wt % of P, not more than 0.05 wt % of of S, 16 to 20 wt % of Cr, 0.5 to 1.5 wt % of Nb, 0.02 to 0.15 wt % of B and balance to 100 of Fe, and is characterized in that said heat-resistant ferritic cast steel member is cast in a lost model made of foamed polymethyl methacrylate.

A lost model made of foamed polymethyl methacrylate is large in heat of decomposition, and in the lost model, molten metal is cooled at a high rate, whereby the molten metal can be cooled in a proper manner, formation of fine particles of carbide is promoted and carburizing is suppressed. Thus a heat-resistant ferritic cast steel member which is excellent in resistance to thermal fatigue and machinability can be obtained.

DESCRIPTION OF THE PREFERRED EMBODIMENTS

EXAMPLE 1

Figure 1:
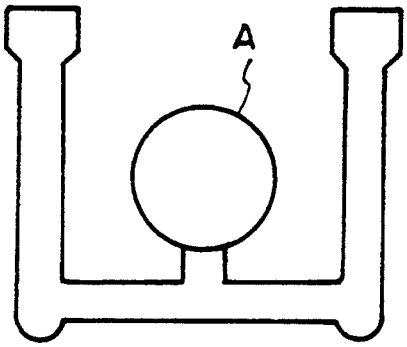
FIG. 1 is a schematic view showing a mold which was used in example 2.

Four test pieces in accordance with first to fourth embodiments of the present invention and five test pieces as first to fifth controls were cast from cast steel materials having compositions shown in table 1. The cast steel material for each test piece was melt in a high frequency furnace weighing 500Kg and the molten cast steel material was cast in a sand mold at 1620° C. The test blank thus obtained was machined into a test piece.

The nine test pieces were subjected to a fatigue test. The fatigue test was conducted in the following manner.

Each test piece was in the form of a rod which was 10mm in diameter and had a gripping portion at each end, and was subjected to strain control thermal fatigue test using a high-frequency heating hydraulic servo tester in the following manner. Each teat piece was heated to 850° C. by high-frequency heating and then cooled to 100° C. by air blow while the test piece was stretched and compressed in the longitudinal direction thereof so that a predetermined strain was obtained. This cycle was repeated until the stress required to keep the predetermined strain sharply changed, and the thermal fatigue life was expressed in the term of the number of cycles at that time. The restraint factor was 0.8. That is, the servo tester was controlled so that the test piece was held in a length longer than the length at 100° C. by 20% of the difference between the lengths at 100° C. and 850° C. in a released state.

The thermal fatigue life, metal structure and mean area of Cr carbide of the test pieces were as shown in table 2.

TABLE 1

| | C | Si | Mn | P | S | Cr | Nb | B | Mo | Ni | Fe |
|---|---|---|---|---|---|---|---|---|---|---|---|
| 1st emb. | 0.18 | 1.35 | 0.76 | 0.027 | 0.009 | 18.6 | 1.21 | 0.043 | — | — | balance |
| 2nd emb. | 0.13 | 0.90 | 0.81 | 0.025 | 0.007 | 18.4 | 1.14 | 0.036 | — | — | balance |
| 3rd emb. | 0.08 | 0.61 | 0.83 | 0.026 | 0.007 | 18.7 | 1.17 | 0.039 | — | — | balance |
| 4th emb. | 0.15 | 1.13 | 0.80 | 0.027 | 0.008 | 18.5 | 1.15 | 0.042 | 0.51 | 0.50 | balance |
| 1st cont. | 0.17 | 1.25 | 0.80 | 0.026 | 0.009 | 18.6 | — | — | — | — | balance |
| 2nd cont. | 0.30 | 1.20 | 0.78 | 0.026 | 0.008 | 18.5 | 1.18 | 0.41 | — | — | balance |
| 3rd cont. | 0.18 | 1.18 | 0.79 | 0.026 | 0.008 | 18.6 | 1.15 | — | — | — | balance |
| 4th cont. | 2.75 | 2.63 | 1.05 | 0.028 | 0.008 | 3.04 | — | — | — | 20.3 | balance |
| 5th cont. | 0.18 | 1.16 | 0.79 | 0.026 | 0.007 | 18.5 | 1.12 | 0.012 | — | — | balance |

TABLE 2

| | t/f life (cycles) | metal structure | Cr carbide mean area ($\mu m^2$) |
|---|---|---|---|
| 1st emb. | 232 | ferrite + Nb carbide + Cr carbide | 646 |
| 2nd emb. | 280 | ferrite + Nb carbide + Cr carbide | 453 |
| 3rd emb. | 296 | ferrite + Nb carbide + Cr carbide | 438 |
| 4th emb. | 275 | ferrite + Nb carbide + Cr carbide | 562 |

TABLE 2-continued

| | t/f life (cycles) | metal structure | Cr carbide mean area ($\mu m^2$) |
|---|---|---|---|
| 1st cont. | 134 | ferrite + Cr carbide | — |
| 2nd cont. | 118 | ferrite + Nb carbide + Cr carbide | 2580 |
| 3rd cont. | 162 | ferrite + Nb carbide + Cr carbide | 1863 |
| 4th cont. | 85 | austenite + spherical graphite + carbide | — |
| 5th cont. | — | ferrite + Nb carbide + Cr carbide | 1032 |

In the fourth embodiment, small amounts of Mo and Ni were added in order to improve strength in deformation at a high temperature. The cast steel for the first control was provided with neither Nb nor B. The cast steel for the second control was a high-carbon steel. The cast steel for the third control was provided with no B. The cast steel for the fourth control was a ductile Ni-resist cast iron. The cast steel for the fifth control was provided with a small amount of B. The thermal fatigue life of the fifth control could not be measured.

As can be understood from table 2, the cast steel members in accordance with the first to fourth embodiment of the present invention which contained Nb in the range of 0.5 to 1.5 wt % and B in the range of 0.02 to 0.15 wt % exhibited excellent thermal fatigue life. On the other hand, cast steel members of the first to fifth controls exhibited short thermal fatigue life. Coarse chrome carbide particles can cause cracks and it is preferred that the mean area of the Cr carbide be not larger than 1000 μm2 in order to increase resistance to thermal fatigue.

EXAMPLE 2

In order to compare sinkage in casting in a sand mold and that in casting in a lost model made of foamed polymethyl methacrylate, a pair of test pieces were formed by casting, at 1620° C., the cast steel material having the same composition as that for the second embodiment in a sand mold and a foamed polymethyl methacrylate lost model which were as shown in FIG. 1 in shape and were equal to each other in size. Then sand was poured into sink marks formed in the spherical portions A (75mm in diameter) of the respective test pieces and the amounts of sand received in the sink marks of the respective test pieces were measure. The amount of sand received in the sink mark of the test piece obtained by casting in the sand mold was 11 cc while that received in the sink mark of the test piece obtained by casting in the foamed polymethyl methacrylate lost model was as small as 1 cc.

When a practical part is formed by casting in a sand mold, riser must be large due to large sinkage and burr is generated along the parting line. The burr must be removed by chipping. However when a practical part is formed by casting in a foamed polymethyl methacrylate lost model, riser may be small since sinkage is small, whereby yield can be increased and at the same time, formation of burr can be suppressed.

EXAMPLE 3

In order to compare the fineness of Cr carbide and the the size of the grain boundaries of Nb carbide in the cast member cast in a sand mold and those in the cast member cast in a foamed polymethyl methacrylate lost model, a pair of test pieces in the form of rods 10mm in diameter were formed by casting the cast steel material having the same composition as that for the second embodiment in a sand mold and a foamed polymethyl methacrylate lost model.

Figure 2:
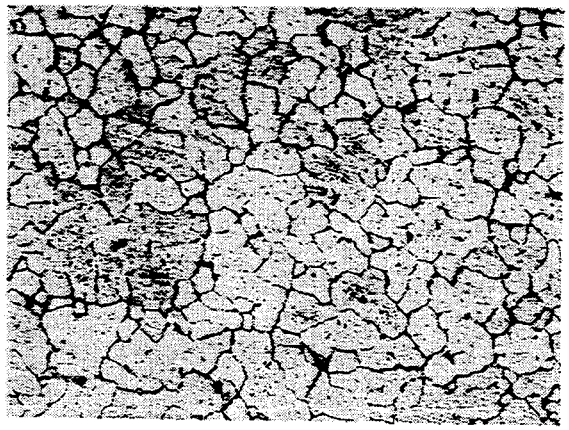
FIG. 2 is a view showing the metal structure of the cast steel member cast in a lost model made of foamed polymethyl methacrylate.

FIG. 2 is a microphotograph of the test piece cast in accordance with the method of the present invention (cast in the foamed polymethyl methacrylate lost model) recorded by an optical microscope at ×100 magnification. The test piece shown in FIG. 2 comprised ferrite, Nb carbide and Cr carbide, and the mean area of Cr carbide particles (observed as black masses in FIG. 2) was 342 $\mu m^2$, and the size of the grain boundaries of Nb carbide (portions surrounded by thin lines in FIG. 2) was relatively small.

Figure 3:
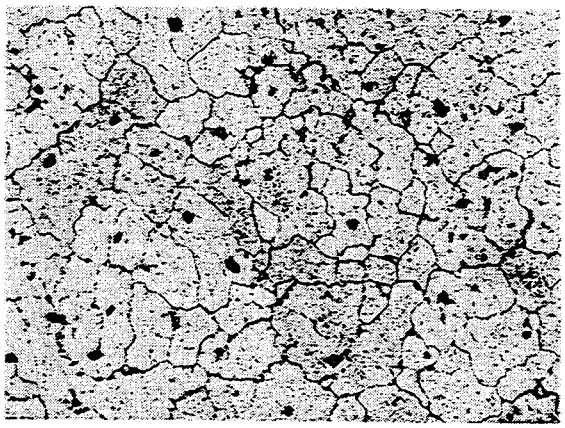
FIG. 3 is a view showing the metal structure of the cast steel member cast in a sand mold.

FIG. 3 is a microphotograph of the test piece cast in the sand mold recorded by an optical microscope at ×100 magnification. The test piece shown in FIG. 3 comprised ferrite, Nb carbide and Cr carbide, and the mean area of Cr carbide particles (observed as black masses in FIG. 3).was 453 $\mu m^2$, and the size of the grain boundaries of Nb carbide (portions surrounded by thin lines in FIG. 2) was relatively large.

As can be understood from FIGS. 2 and 3, when cast steel is cast in the foamed polymethyl methacrylate lost model, the Cr carbide is finer than when the cast steel is cast in the sand mold, whereby the thermal fatigue life is greatly improved.

EXAMPLE 4

A pair of test pieces in the form of-rods 10 mm in diameter were formed by casting the cast steel material having the same composition as that for the second embodiment in a foamed polystyrene lost model and a foamed polymethyl methacrylate lost model. Then whether carburizing occurred in the test pieces was checked.

Figure 4:
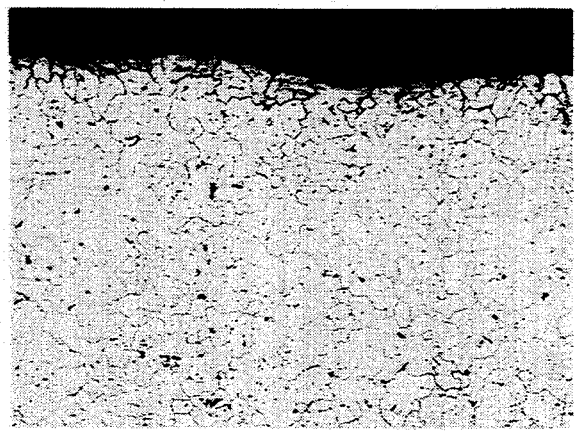
FIG. 4 is a view showing the metal structure of a part near the surface of the cast steel member cast in a lost model made of foamed polymethyl methacrylate.

FIG. 4 is a microphotograph of the test piece cast in accordance with the method of the present invention (cast in the foamed polymethyl methacrylate lost model) recorded by an optical microscope at ×50 magnification.

Figure 5:
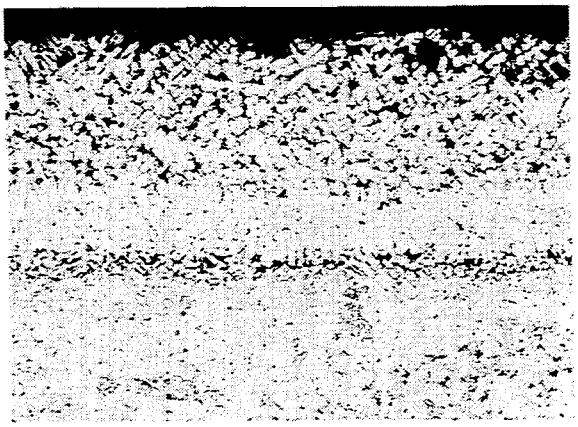
FIG. 5 is a view showing the metal structure of a part near the surface of the cast steel member cast in a lost model made of foamed polystyrene.

FIG. 5 is a microphotograph of the test piece cast in the foamed polystyrene lost model recorded by an optical microscope at x50 magnification.

The test piece shown in FIG. 4 exhibited 220 in Vickers hardness and was excellent in resistance to thermal fatigue and machinability. This may be because the foamed polymethyl methacrylate lost model is large in heat of decomposition, and in the lost model, molten metal is cooled at a high rate, and carbon does not enter the surface of the cast member.

On the other hand, the test piece shown in FIG. 5 exhibited 392 in Vickers hardness at the surface thereof and inferior resistance to thermal fatigue. This may be because carbon from the foamed polystyrene lost model enters the surface of the cast member and forms a large amount of carbide. A large amount of carbide deteriorates resistance to thermal fatigue and a high Vickers hardness deteriorates machinability of the cast member.

What is claimed is;

1. A heat-resistant ferritic cast steel member composed of 0.05 to 0.25 wt % of C, 0.3 to 2.0 wt % of Si, 0.2 to 2.0 wt % of Mn, not more than 0.05 wt % of P, not more than 0.05 wt % of S, 16 to 20 wt % of Cr, 0.5 to 1.5 wt % of Nb, 0.02 to 0.15 wt % of B and balance to 100 of Fe, fine niobium carbide particles being dispersed wherein a mean area of Cr carbide particles is not larger than 1000 $\mu m^2$.

2. A heat-resistant ferritic cast steel member composed of 0.05 to 0.25 wt % of C, 0.3 to 2.0 wt % of Si, 02 to 1.0 wt % of Mn, not more than 0.05 wt % of P, not more than 0.05 wt % of S, 16 to 20 wt % of Cr, 0.5 to 1.5 wt % of Nb, 0.02 to 0.15 wt % of B and balance to 100 of Fe, fine niobium carbide particles being dispersed wherein said heat-resistant ferritic cast steel member is cast in a lost model made of foamed polymethyl methacrylate.

3. A heat-resistant ferritic cast steel member composed of 0.05 to 0.25 wt % of C, 0.3 to 2.0 wt % of Si, 0.2 to 1.0 wt % of Mn, not more than 0.05 wt % of P, not more than 0.05 wt % of S, 16 to 20 wt % of Cr, 0.5 to 1.5 wt % of Nb, 0.02 to 0.15 wt % of B and balance to 100 of Fe, fine niobium carbide wherein said heat-resistant ferritic cast steel member is cast in a lost model made of foamed polymethyl methacrylate, and a mean area of Cr carbide particles is not larger than 1000 $\mu m^2$.

* * * * *